US008899853B2

(12) United States Patent
Kikuchi et al.

(10) Patent No.: US 8,899,853 B2
(45) Date of Patent: Dec. 2, 2014

(54) CONVEYANCE APPARATUS AND PRINTER

(75) Inventors: Tetsuo Kikuchi, Ayase (JP); Ryoya Shinjo, Kawasaki (JP); Yuki Igarashi, Tokyo (JP); Haruhiko Tanami, Fuchu (JP); Ryohei Maruyama, Kawasaki (JP); Shin Genta, Yokohama (JP); Naoki Wakayama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 13/556,589

(22) Filed: Jul. 24, 2012

(65) Prior Publication Data

US 2013/0026283 A1 Jan. 31, 2013

(30) Foreign Application Priority Data

Jul. 27, 2011 (JP) ..... 2011-164171

(51) Int. Cl.
*B41J 15/16* (2006.01)
*B65H 23/185* (2006.01)
*B65H 20/00* (2006.01)

(52) U.S. Cl.
CPC ..... *B65H 20/005* (2013.01); *B65H 2403/942* (2013.01); *B65H 2404/14* (2013.01); *B65H 23/185* (2013.01); *B65H 2301/512125* (2013.01); *B65H 2701/1311* (2013.01); *B65H 2511/112* (2013.01); *B65H 2515/32* (2013.01); *B65H 2801/12* (2013.01)
USPC ..... 400/611; 347/104

(58) Field of Classification Search
CPC ..... B41J 15/16
USPC ..... 400/614
See application file for complete search history.

(56) References Cited

U.S. PATENT DOCUMENTS

| | | | | | |
|---|---|---|---|---|---|
| 4,043,440 | A * | 8/1977 | Busch | 400/614 |
| 4,755,833 | A * | 7/1988 | Tanigawa et al. | 347/176 |
| 5,607,245 | A * | 3/1997 | Siwinski | 400/614 |
| 6,109,805 | A * | 8/2000 | Ono et al. | 400/618 |
| 8,328,318 | B2 * | 12/2012 | Igarashi et al. | 347/16 |
| 8,485,462 | B2 * | 7/2013 | Nakamaki et al. | 242/418.1 |
| 2005/0232677 | A1 * | 10/2005 | Ogawa et al. | 400/611 |
| 2010/0053251 | A1 | 3/2010 | Igarashi et al. | |

FOREIGN PATENT DOCUMENTS

| | | | | |
|---|---|---|---|---|
| CN | 1280064 | A | 1/2001 | |
| JP | 11048551 | A * | 2/1999 | |
| JP | 2005-096987 | A | 4/2005 | |
| JP | 2005280055 | A * | 10/2005 | B41J 15/16 |
| JP | 2008-155417 | A | 7/2008 | |
| JP | 2008155417 | A * | 7/2008 | |
| JP | 2009274306 | A * | 11/2009 | B41J 15/16 |

* cited by examiner

*Primary Examiner* — Nguyen Ha
(74) *Attorney, Agent, or Firm* — Canon USA Inc. IP Division

(57) ABSTRACT

A conveyance apparatus includes: a supply unit rotatably supporting a roll member around which a sheet is wound in form of a roll and configured to supply the sheet from the roll member; a motor for rotating the roll member; a roller pair configured to convey the sheet supplied from the supply unit while pinching the sheet; and a control unit configured to set the torque of the motor according to sheet information related to the sheet when taking up the sheet on the roll member by driving the motor while the sheet is pinched by the roller pair being stopped.

14 Claims, 12 Drawing Sheets

FIG. 7

| KIND OF SHEET | | SHEET WIDTH SMALL | | SHEET WIDTH LARGE | |
|---|---|---|---|---|---|
| SETTING | FEATURE | WINDING SMALL | WINDING LARGE | WINDING SMALL | WINDING LARGE |
| SHEET M | FRAGILE PAPER | Am1 | Am2 | Am3 | Am4 |
| SHEET S | SLIPPERY PAPER | As1 | As2 | As3 | As4 |
| SHEET F | ORDINARY PAPER | Af1 | Af2 | Af3 | Af4 |
| SHEET K | HIGHLY STIFF PAPER | Ak1 | Ak2 | Ak3 | Ak4 |

FIG. 10

| KIND OF SHEET | | CURRENT VALUE |
|---|---|---|
| SETTING | FEATURE | |
| SHEET M | FRAGILE PAPER | Am |
| SHEET S | SLIPPERY PAPER | As |
| SHEET F | ORDINARY PAPER | Af |
| SHEET K | HIGHLY STIFF PAPER | Ak |

CONVEYANCE APPARATUS AND PRINTER

BACKGROUND OF THE INVENTION

1. Field of the Invention

The present invention relates to a conveyance apparatus configured to convey a sheet in form of a roll.

2. Description of the Related Art

In an image recording apparatus (printer) equipped with a conveyance apparatus, images and characters are recorded on a continuous sheet paid out from a roll sheet. In this printer, the conveyance and stop of the sheet by a conveyance roller are repeated for the purpose of recording, and the recording is performed with ink discharged from a recording head configured to perform scanning in a direction crossing the conveyance direction while the sheet is stopped.

In such a apparatus, a metal shaft passes through the rotation center of a roll member, around which the continuous sheet is wound, and the roll member is rotatably set in the printer via the metal shaft. At the core of this metal shaft, there is provided a torque limiter for applying a braking force. As the roll sheet is conveyed, a constant back tension is applied to the roll sheet (See Japanese Patent Application Laid-Open No. 2005-096987).

In the printer, when the roll sheet is paid out by a conveyance roller by a length needed for recording, the roll member may continue to rotate for some time due to the inertial weight of the roll member around which the roll sheet is wound. In such cases, the roll sheet is paid out by an excessive amount from the roll member, resulting in generation of slack in the roll sheet. The slack amount varies depending on the inertial weight of the roll member and the peripheral speed of the conveyance roller. The larger the inertial weight of the roll member, and the higher the peripheral speed of the roll member, the greater the slack generated in the roll sheet paid out from the roll member.

In the case where the roll sheet is greatly slackened immediately after the conveyance operation, no tension is generated in the roll sheet at the time of the next conveyance operation. Then, as the roll sheet is conveyed, the slack is gradually reduced. At the moment that the slack is eliminated, there is generated large tension in the direction opposite to the conveyance direction of the roll sheet. During this conveyance, slack is generated in the roll sheet again.

On the other hand, in the case where the slack immediately after the conveyance operation starts is small, the slack is eliminated during the next conveyance operation, and large tension is generated in the direction opposite to the conveyance direction of the roll sheet. Therefore, the slack in the roll sheet varies depending on the inertial weight of the roll member and the peripheral speed. Each time the conveyance operation is performed, the tension acting on the roll sheet changes.

This change in the tension acting on the roll sheet greatly affects the conveyance precision of the roll sheet. In the case where the tension of the roll sheet is large, the slippage of the roll sheet on the conveyance roller increases during conveyance operation, and the conveyance amount of the roll sheet decreases by an amount corresponding to this slippage. Even when the tension is large, when the tension is constant, it is possible to prevent variation in the actual feeding amount by adding a predetermined fixed correction value to the feeding amount. However, in the case where slack is generated in the roll sheet in the conveyance operation, the tension changes for each conveyance operation, so that it is rather difficult to correct the feeding amount by the predetermined correction value, resulting in deterioration in feeding accuracy.

To address this problem, a printer is proposed which rewinds back the roll sheet prior to the start of the conveyance operation based on an estimated length of slack in the roll sheet which can be generated after the conveyance of the sheet by the conveyance roller by an amount corresponding to the estimated slack length (See Japanese Patent Application Laid-Open No. 2008-155417).

By eliminating the slack in the roll sheet prior to the start of the conveyance operation, it is possible to reduce the change in the tension generated during the conveyance operation, so that it is possible to secure the requisite feeding accuracy by correcting the feeding amount by the predetermined correction value.

However, in the configuration discussed in Japanese Patent Application Laid-Open No. 2008-155417, when winding-back the roll sheet in order to remove slack from the roll sheet, a fixed winding-back force is applied. Thus, in the case of a slippery roll sheet, the roll sheet slips on the conveyance roller after the slack has been removed. As a result, the nip position of the roll sheet held between the conveyance roller and the pinch roller can be deviated. In this case, a non-image area appears at a joint portion between recorded images for each reciprocating operation of the recording head, generating white stripes in the recorded images. Further, in the case of a sheet of high stiffness, the slack cannot be sufficiently removed, and, at the time of the next conveyance operation, reverse tension due to the slack is produced, so that in some cases, black stripes are generated at the joint portion between the images due to deficiency of conveyance.

SUMMARY OF THE INVENTION

The present invention is directed to a conveyance apparatus capable of suppressing generation of slippage between the conveyance roller and the sheet when eliminating the slack generated in the sheet, making it possible to perform a satisfactory conveyance operation.

According to an aspect of the present invention, a conveyance apparatus includes: a supply unit rotatably supporting a roll member around which a sheet is wound in form of a roll and configured to supply the sheet from the roll member; a motor for rotating the roll member; a roller pair configured to convey the sheet supplied from the supply unit while pinching the sheet; and a control unit configured to set the torque of the motor according to sheet information related to the sheet when taking up the sheet on the roll member by driving the motor while the sheet is pinched by the roller pair being stopped.

According to the present invention, when eliminating slack generated in the sheet, it is possible to suppress generation of slippage between the conveyance roller and the slip, making it possible to perform a satisfactory conveyance operation.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 7 is a diagram illustrating the value of an electric current supplied to a feeding motor according to the kind of roll sheet, width size, and the winding diameter of the roll member.

FIG. 10 is a diagram illustrating the values of electric currents supplied to the feeding motor according to the kind of the sheet.

DESCRIPTION OF THE EMBODIMENTS

Various exemplary embodiments, features, and aspects of the invention will be described in detail below with reference to the drawings.

In the following, an exemplary embodiment of the present invention will be illustrated in detail with reference to FIGS. 1 through 3.

Figure 1:
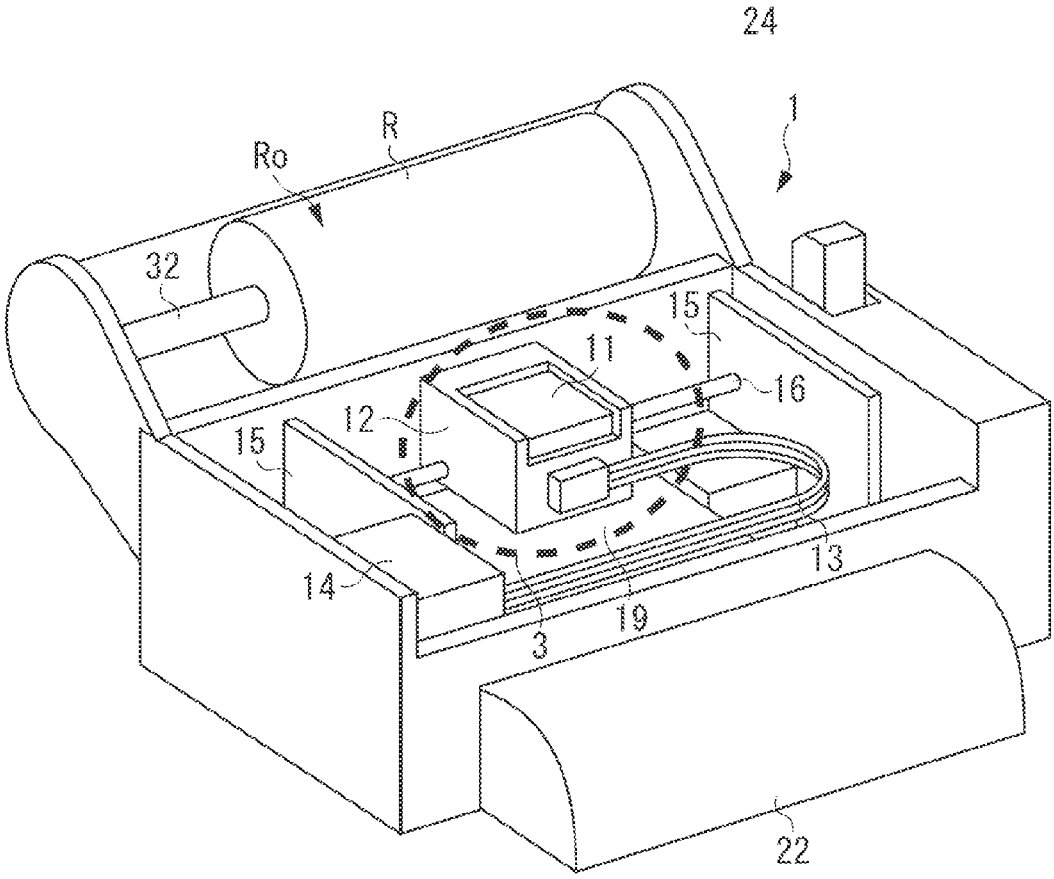
FIG. 1 is a perspective view schematically illustrating the construction of an ink jet printer according to a first exemplary embodiment.

FIG. 1 is a perspective view of an ink jet printer according to the first exemplary embodiment configured to perform printing on sheets. FIG. 2 is a perspective view of a roll sheet mounting structure in the ink jet printer according to the first exemplary embodiment. FIG. 3 is a sectional view schematically illustrating the ink jet printer.

As shown in FIG. 1, in the ink jet printer 1 according to the present exemplary embodiment (hereinafter referred to as the printer 1), a roll sheet R which is a continuous sheet wound up in the form of a roll, is used as the sheet. In the present exemplary embodiment, the continuous sheet R in the form of a roll will be referred to as a roll member Ro. The sheet R is paid out from the roll member Ro.

The printer 1 of the present exemplary embodiment is equipped with a recording unit 3 configured to perform recording of images or the like on the sheet R, a feeding unit as a supply unit for supplying the sheet R from the roll member Ro, and a conveyance unit configured to convey the sheet R supplied from the feeding unit to the recording unit 3.

The feeding unit rotatably supports the roll member Ro, and has a roll motor configured to rotate the roll member Ro. The conveyance unit has an LF roller 9 configured to convey the sheet R while pinching the same and a pinch roller 10 configured to pinch the sheet in cooperation with the LF roller 9, constituting a conveyance roller pair, and an LF motor as a conveyance motor rotating the LF roller 9. Using the LF roller, the conveyance unit performs an intermittent conveyance from the feeding unit to the recording unit 3, repeating the conveyance and stop of the sheet R. Further, the printer 1 is equipped with a control unit described below configured to control driving of the roll motor and the LF motor.

The conveyance apparatus is equipped with the feeding unit and the conveyance unit according to the present exemplary embodiment, therefore, strictly speaking, it should be referred to as a supply conveyance apparatus. For the sake of convenience, however, it will be simply referred to as the conveyance apparatus.

First, the operation of setting the roll sheet R in the ink jet printer 1 according to the present exemplary embodiment will be described.

Figure 2:
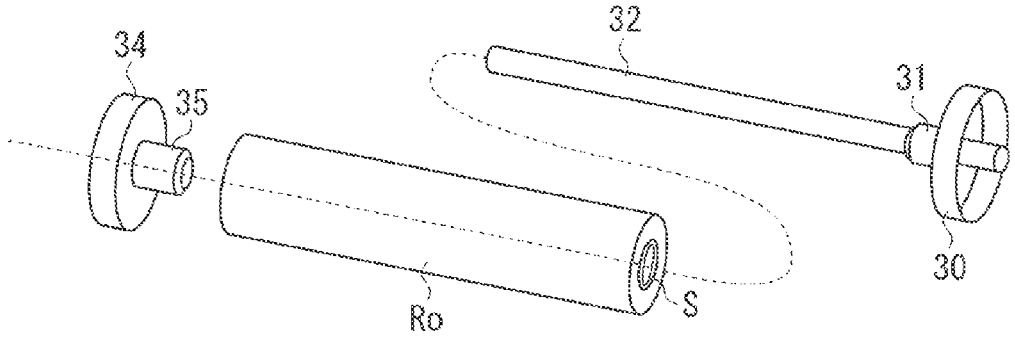
FIG. 2 is a perspective view illustrating a roll sheet mounting structure in the ink jet printer according to the first exemplary embodiment.
Figure 3:
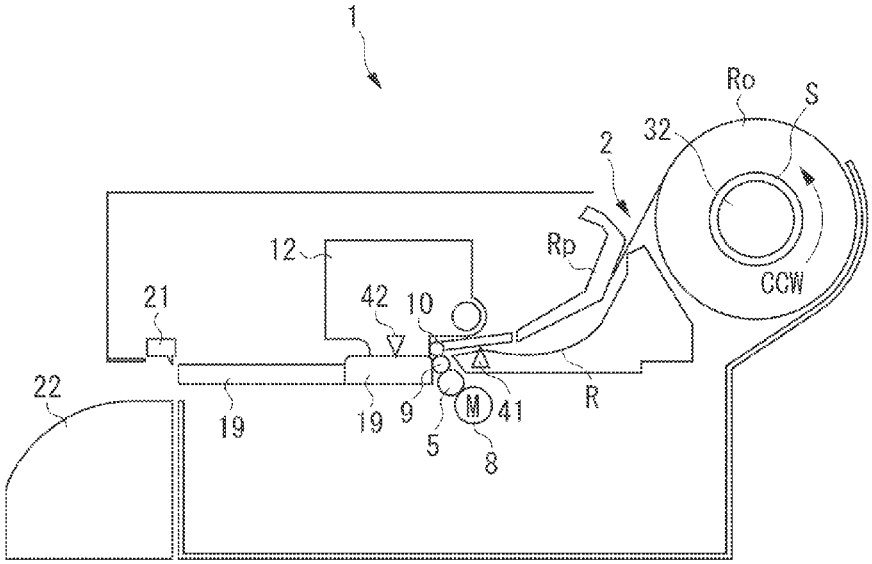
FIG. 3 is a schematic sectional view of the ink jet printer according to the first exemplary embodiment.

As shown in FIG. 2, the roll member Ro of the roll sheet R is supported by a spool shaft 32 passing through a cylindrical paper tube S situated at the winding center. At one end of the spool shaft 32, there is provided a reference side roll sheet holder 30 retaining the roll member Ro. A reference side engagement portion 31 of the reference side roll sheet holder 30 is inserted into the paper tube S, and is radially engaged with the inner wall of the paper tube S by elastic force, so that the roll member Ro is fixed to the reference side roll sheet holder 30. The reference side roll sheet holder 30 is supported around the spool shaft 32 and preventing from rotating.

Further, from the other end portion of the spool shaft 32, the spool shaft 32 passes through a non-reference-side roll sheet holder 34 through the spool shaft 32 so as to hold both ends of the roll member Ro, such that the non-reference-side roll sheet holder 34 is engaged with the paper tube S. Like the reference side roll sheet holder 30, the non-reference-side roll sheet holder 34 also has a non-reference side engagement portion 35, and expands in the radial direction of the paper tube S by an elastic force to engage with the inner wall of the paper tube S, so that the roll member Ro is fixed to the non-reference-side roll sheet holder 34. And, as illustrated in FIG. 1, both end portions of the spool shaft 32 are rotatably supported by the printer 1, so that the roll member Ro of the roll sheet R is also rotatably supported. In the following illustration, the leading edge in the conveyance direction of the sheet R paid out of the roll member Ro will be referred to as the leading edge Rp.

Next, the feeding operation of the sheet R will be described. As illustrated in FIG. 3, the roll member Ro is set at a predetermined attachment position, and the leading edge Rp of the roll sheet R paid out of the roll member Ro is guided to a supply port 2 by the hand of the user. The user rotates the roll member Ro counterclockwise as seen in FIG. 3, so that the leading edge Rp of the sheet R paid out of the roll member Ro is fed downstream through the conveyance path.

In the middle of the conveyance path, there is provided a reflection light type sheet detection sensor 41, which is configured to detect passage of the leading edge Rp of the roll sheet R. When the sheet detection sensor 41 detects the sheet, an LF roller 9 serving as the conveyance roller constituting the conveyance unit starts to rotate counterclockwise with respect to the roll member Ro by an LF motor 8 as the conveyance motor. Subsequently, the leading edge Rp of the sheet R sent downstream in the conveyance direction by the hand of the user reaches a nip portion of the roller pair consisting of the LF roller 9 and the pinch roller 10, and the sheet R is conveyed onto a platen 19 while pinched by the roller pair including the LF roller 9 and the pinch roller 10. At this time, passing of the sheet R is detected by a sheet end detection sensor 42 mounted on a carriage 12, and it is confirmed that the sheet R has been reliably brought onto the platen 19. Further, the sheet end detection sensor 42 is reciprocated along a guide shaft 16 and a guide rail arranged parallel to each other, so that the sheet width of the sheet R is detected.

In subsequent operation, the conveyance of the sheet R is automatically performed by the LF roller 9, so that, at this point, the user releases the sheet R. In a drive gear row of the LF roller 9, there is arranged an LF encoder 5 configured to detect the rotation of the LF roller 9. Further, in the vicinity of the outer peripheral surface of the roll member Ro, there is provided a contact type winding diameter detection sensor 43 held in direct contact with the sheet R wound around the roll member Ro and configured to detect the winding diameter of the roll member Ro.

Next, a recording unit 3 configured to perform recording of images on the sheet R conveyed to the platen 19 will be described. The recording unit 3 has a recording head 11 serving as the printing unit, a carriage 12 on which the recording head 11 is mounted, and the platen 19 provided opposite the recording head 11. This recording head 11 has, on its surface opposite the recording surface, a plurality of nozzle rows (not illustrated) arranged in a sub scanning direction, and inks of different colors are discharged from different nozzle rows. Ink of each color is supplied to nozzles for each color of the recording head 11 from an ink tank via respective supply tubes 13.

The carriage 12 is slidably supported by the guide shaft 16 and the guide rail (not illustrated) whose both end portions are fixed to a frame 15 of the printer 1 and which are arranged parallel to each other. The ink is discharged from the recording head 11 toward the roll sheet R conveyed up to the recording unit 3 while reciprocating the carriage 12 to record an image on the sheet R.

When one line of an image is recorded at the recording unit by scanning of forward movement or backward movement of the carriage 12, the sheet R is fed in an intermittent manner by a predetermined pitch in the conveyance direction by the LF roller 9, and the scanning by the carriage 12 is performed again to perform image recording of the next line. This process is repeated to record the image over an entire page and then the recorded portion is conveyed onto a discharge tray 22.

When the image recording operation is completed, the sheet R is conveyed to a predetermined cutting position by the LF roller 9, and is cut by a cutter 21. The above processing is a series of operations from the setting of the roll member Ro to the discharge of the sheet R.

Figure 4:
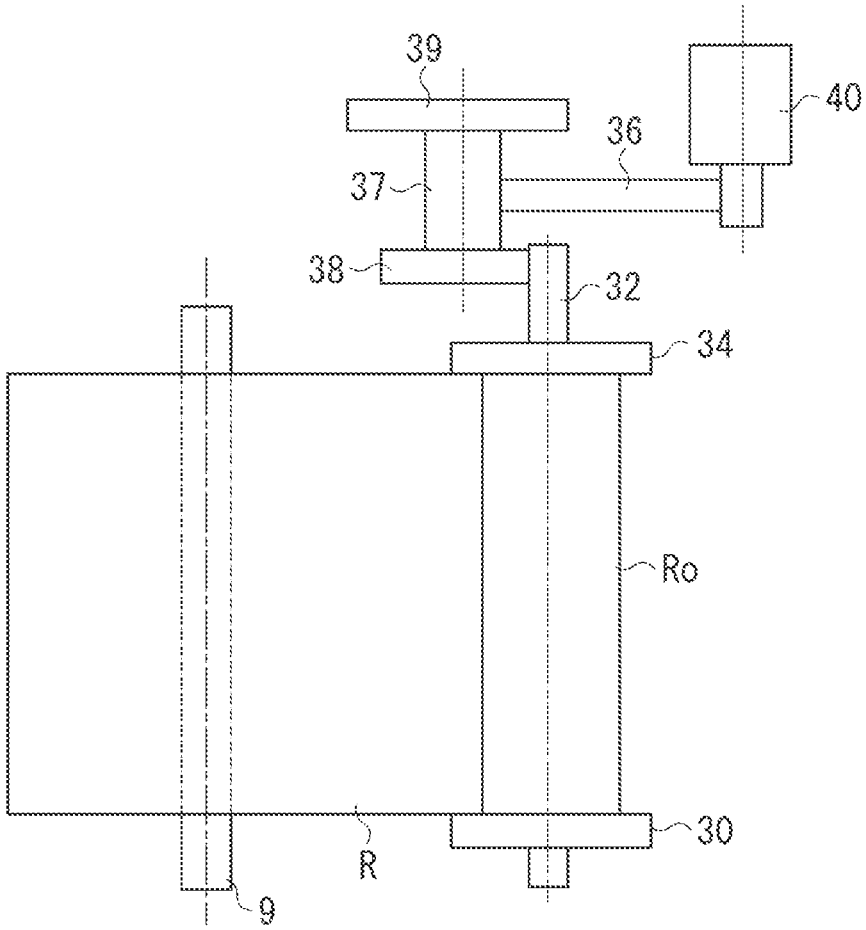
FIG. 4 is a plan view schematically illustrating a roll sheet feeding unit and a conveyance unit according to the first exemplary embodiment.

Next, the construction of the roll member Ro mounting portion constituting the feeding unit of the present exemplary embodiment will be described in detail with reference to FIG. 4. FIG. 4 is a schematic plan view of the roll sheet R mounting portion according to the present exemplary embodiment. The feeding unit is equipped with a feeding mechanism which can rotate the roll member Ro around the center axis to convey the sheet R independently of the conveyance operation caused by the rotation of the LF roller 9 to wind-back the sheet R through reverse rotation of the roll member Ro. The feeding mechanism includes a feeding motor 40 as a roll motor for rotating the roll member Ro, gear rows 36 through 38 for transmitting the driving force of the feeding motor 40 to the roll member Ro, and a feeding encoder 39 for detecting the rotation of the roll member Ro.

Figure 5:
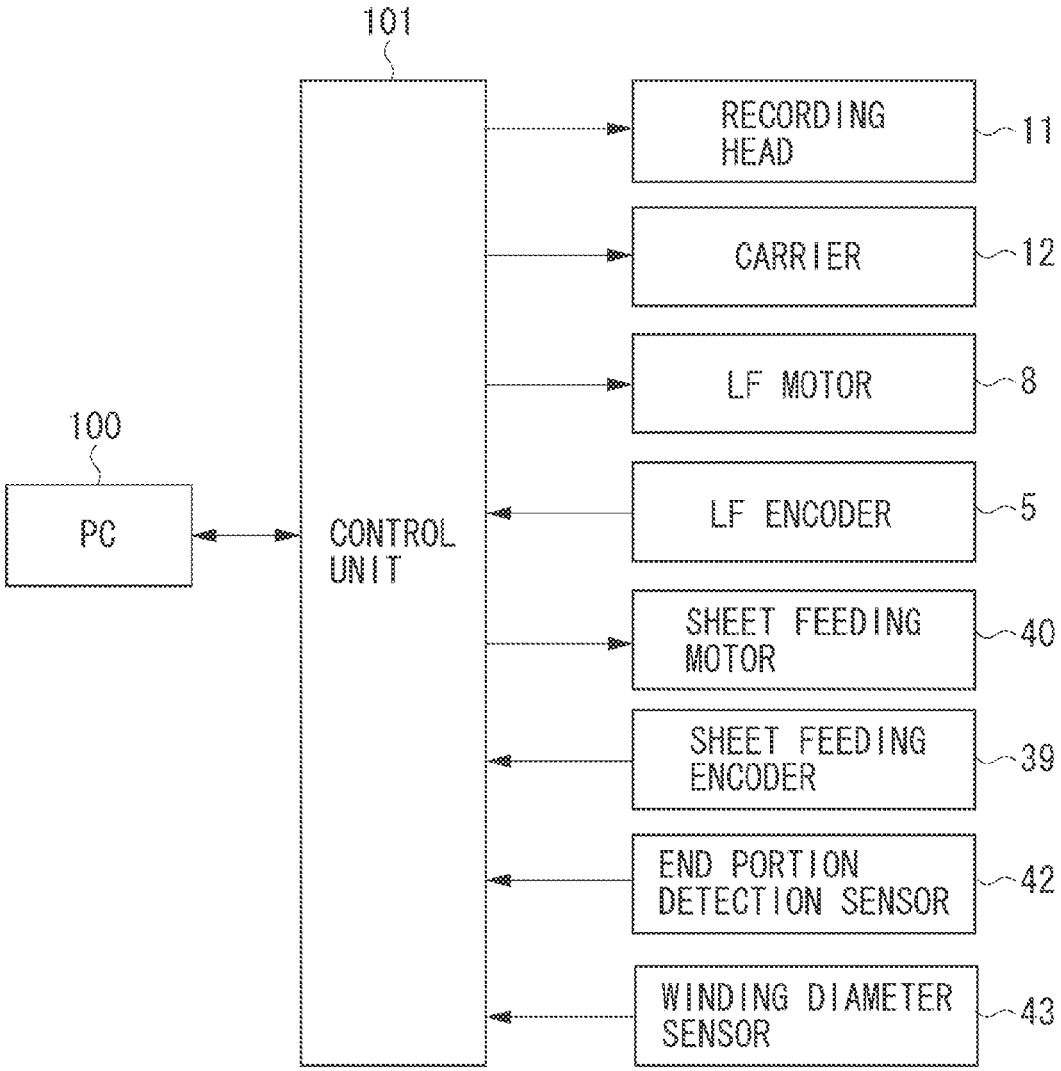
FIG. 5 is a block diagram illustrating a control system for the roll sheet conveyance operation in the first exemplary embodiment.

Next, the control system for the operations of feeding and conveying the sheet R in the printer 1 according to the first exemplary embodiment will be described with reference to FIG. 5. FIG. 5 is a schematic block diagram illustrating the control system for the operations of feeding and conveying the sheet R according to the present exemplary embodiment. The control system is equipped with a control unit 101 as a first control unit and a second control unit which, upon receiving a signal of recording information (printing information) output from a personal computer (PC) 100, control the driving timing of the recording head 11, the carriage 12, the LF motor 8, and the feeding motor 40. The LF motor 8 and the feeding motor 40 are drive-controlled independently of each other by the control unit 101. Although in the present exemplary embodiment the control unit 101 serves as both the first control unit and the second control unit, it is also possible to provide a first control unit and a second control unit independently of each other.

Figure 6:
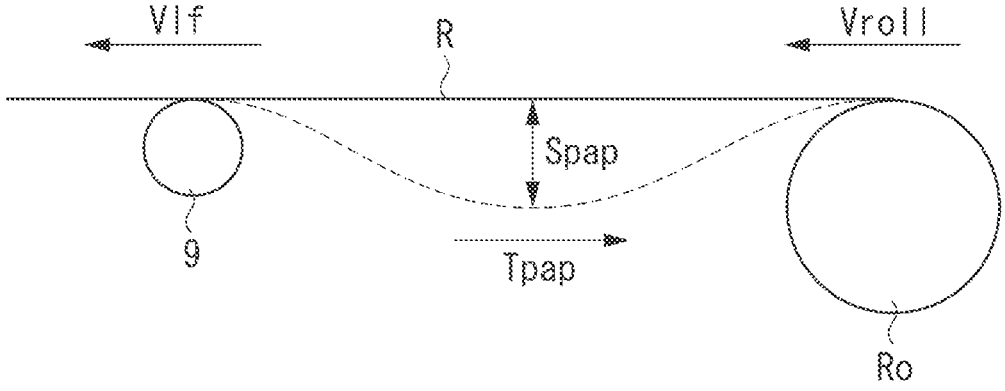
FIG. 6 is a diagram illustrating the relationship between the load, conveyance speed, and sheet slack amount of the roll sheet at the feeding unit and the conveyance unit in the first exemplary embodiment.

FIG. 6 is a diagram illustrating the relationship among the load acting on the roll sheet R astride the roll member Ro of the feeding unit and the LF roller 9 of the conveyance unit, the conveyance speed of the roll sheet, and the sheet slack amount. The load force acting on the roll sheet R between the LF roller 9 and the roll member Ro will be referred to as Tpap, the conveyance speed arising due to the LF roller 9 will be referred to as Vlf, the conveyance speed arising due to the roll member Ro will be referred to as Vroll, and the amount of sheet slack generated in the roll sheet R between the LF roller 9 and the roll member Ro will be referred to as Spap.

The conveyance speed Vlf and the conveyance speed Vroll are peripheral speed on a circumference. The conveyance speed Vlf is the peripheral speed of the LF roller 9 on the circumference, and the conveyance speed Vroll is the peripheral speed of the roll member Ro on the circumference. The conveyance speeds Vlf and Vroll will be referred to below as the peripheral speeds Vlf and Vroll. As illustrated in FIG. 6, the sheet slack amount Spap is the amount of displacement in the thickness direction of the roll sheet R when there is no slack.

The load force Tpap, the peripheral speeds Vlf and Vroll are positive values in the direction of the arrow in FIG. 6. The sheet slack amount Spap is zero when there is no slack, and the slack amount will be indicated by an absolute value. The load force Tpap is zero when there is some slack. As the roll sheet R is taken up with the roll sheet R nipped between the LF roller 9 and the pinch roller 10, the slack is reduced gradually. When the roll sheet R attains a tense state, the load force Tpap>0. In the waveform diagrams given in FIGS. 9 and 12, the direction as indicated in FIG. 6 serves as a reference.

Figure 8:
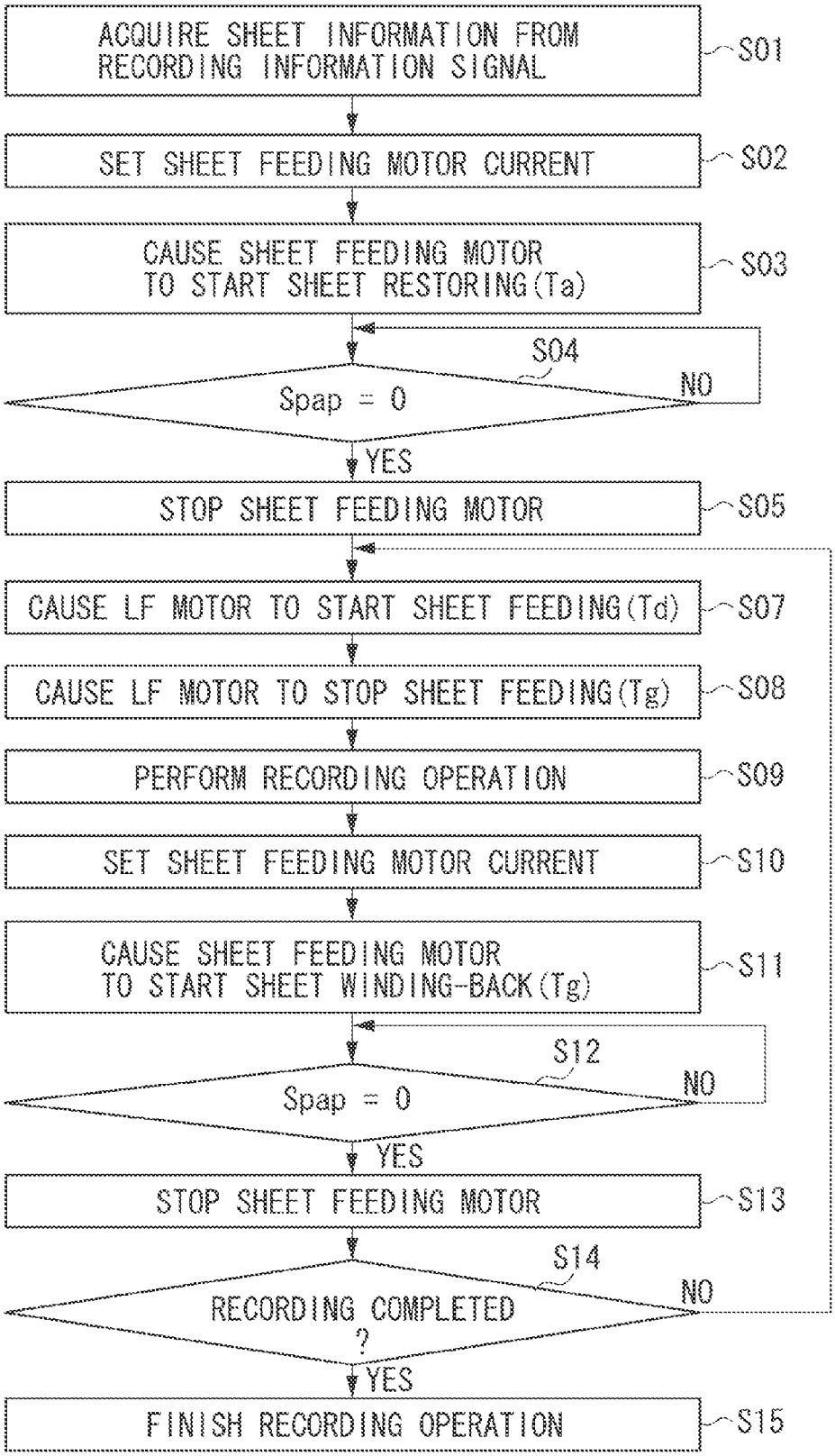
FIG. 8 is a flowchart illustrating the operation procedures in the first exemplary embodiment.
Figure 9:
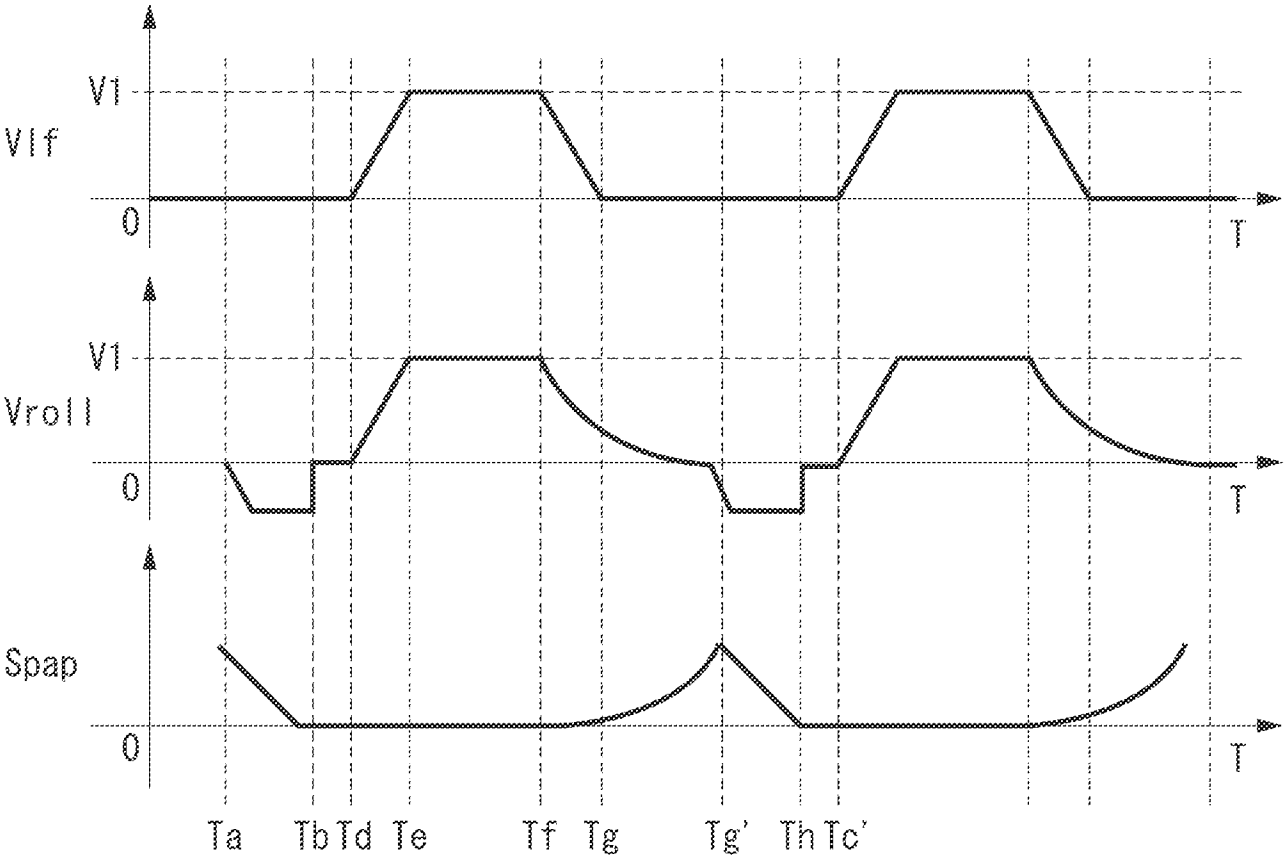
FIG. 9 is a diagram illustrating the relationship between the conveyance speed of a low-frequency (LF) roller, the conveyance speed of the roll member, and the sheet slack amount in the first exemplary embodiment.

Next, the operational relationship between the LF roller 9 and the roll member Ro in the present exemplary embodiment will be described with reference to FIGS. 8 and 9. FIG. 8 is a flowchart illustrating the operational procedures in the present exemplary embodiment. FIG. 9 is a diagram illustrating the relationship between the peripheral speed Vlf of the LF roller 9, the peripheral speed Vroll of the roll member Ro, and the sheet slack amount Spap in the present exemplary embodiment. In the graph in the top portion of FIG. 9, the vertical axis indicates the peripheral speed Vlf of the LF roller 9, and the horizontal axis indicates time T. In the graph in the middle portion of FIG. 9, the vertical axis indicates the peripheral speed Vroll of the roll member Ro, and the horizontal axis indicates the time T. In the graph in the bottom portion of FIG. 9, the vertical axis indicates the slack amount Spap of the sheet R between the LF roller 9 and the roll member Ro, and the horizontal axis indicates the time T.

FIG. 7 illustrate the value of an electric current supplied to the feeding motor 40 according to the kind of the roll sheet R, the width size, and the winding diameter of the roll member Ro. By supplying the electric current as illustrated in FIG. 7, it is possible to take up appropriately the roll sheet R in proper quantities. For example, when conveying a sheet M (fragile sheet), if it is determined that the sheet width of the roll sheet R is small and that the winding diameter of the roll member Ro is large, an electric current Am2 is supplied to the feeding motor 40. The feeding motor 40 increases its rotational torque in proportion to the value of the current supplied thereto. The control unit 101 increases or decreases this electric current value, thereby controlling the take-up force.

As illustrated in FIG. 8, a signal of recording information output from the PC 100 is input to the control unit of the printer 1 in step S01. Apart from image information, the signal of recording information output from the PC 100 includes sheet information (the kind of sheet, etc.). By receiving the signal of recording information, it is possible to acquire sheet information in step S01. The sheet information such as the sheet width and winding diameter is detected and acquired by the winding diameter detection sensor 43 and the sheet end detection sensor 42 during the feeding operation. As illustrated in FIG. 7, based on the sheet information, the value of the electric current supplied to the feeding motor 40 is set in step S02. At the time of winding back the sheet, according to the above sheet information, the control unit 101 varies the value of the electric current supplied to the feeding motor 40, starting an optimum sheet winding back operation (Ta) corresponding to the sheet R in step S03.

For example, in the case where a slippery sheet R like a glossy sheet, where the sheet width is small, and where the winding diameter of the roll member Ro is small, the electric current value (As1) for the feeding motor 40 is reduced, and the load force Tpap acting on the sheet R between the LF roller 9 and the roll member Ro is reduced, thereby preventing slippage of the sheet R on the LF roller 9. When the sheet width of the sheet R is small or when the winding diameter of the roll member Ro is small, the electric current value for the feeding motor 40 is reduced because when the sheet width is small, the nip width at the LF roller 9 is small, and the grip force is weak, which makes the sheet R slip on the LF roller 9. In addition, the electric current value for the feeding motor 40 is diminished because when the winding diameter of the roll member Ro is small, the load force Tpap on the sheet R between the LF roller 9 and the roll member Ro is larger as compared with the case where the winding diameter is large. More specifically, the load force Tpap on the sheet R between the LF roller 9 and the roll member Ro increases, so that the sheet R becomes subject to slippage on the LF roller 9.

In the case where a sheet R with a fragile ink absorbing receptive layer is used, where the sheet width is small, and where the winding diameter is small, the electric current value (Am1) for the feeding motor 40 is further suppressed. Due to this arrangement, the load force Tpap on the sheet R between the LF roller 9 and the roll member Ro is reduced, thereby preventing slippage of the sheet R on the LF roller 9 and cracking of the sheet R due to excessive pulling.

On the other hand, when a sheet R is used which does not easily undergo slippage and which exhibits high stiffness as in the case of art paper, when the winding diameter of the roll member Ro is large, it is unlikely that cracking is generated on the sheet surface due to excessive pulling. Thus, by augmenting the electric current value (Ak4) for the feeding motor 40, the sheet winding back operation is reliably performed so that sheet is sufficiently wound back.

When the sheet width is large or when the winding diameter is large, the electric current value for the feeding motor 40 is augmented because when the winding diameter of the roll member Ro is large, the load force Tpap on the sheet R between the LF roller 9 and the roll member Ro is smaller as compared with the case where the winding diameter is small. More specifically, when the take-up force is weak, it is necessary to prevent the take-up force from giving in to the stiffness of the sheet R and generate a sufficient take-up amount. In this case, when the sheet width is large, the nip width at the LF roller 9 is large, and the grip force is strong, so that the sheet R is not likely to slip on the LF roller 9, making it possible to increase the electric current for the feeding motor 40.

To summarize the above, when taking up a sheet of a first width, the value of an electric current supplied to the feeding motor is made smaller than when taking up a sheet of a second, larger width. When taking up a sheet on a roll member of a first winding diameter, the value of the electric current supplied to the feeding motor is made smaller than when taking up the sheet on a roll member of a second winding diameter that is larger than the first winding diameter. When taking up a first sheet subject to slippage on the roller, the value of the electric current supplied to the feeding motor is made smaller than when taking up a second sheet that is less subject to slippage.

When taking up a first sheet with a fragile ink absorbing receptive layer, the value of the electric current is made smaller than when taking up a second sheet whose receptive layer is more resistant. When taking up a first sheet of low stiffness, the value of the electric current supplied to the feeding motor is made smaller than when taking up a second sheet of higher stiffness. The characteristics of the feeding motor 40 is such that the rotational torque increases in proportion to the value of the electric current supplied thereto, so that the magnitude of the electric current supplied may be regarded as the magnitude of the torque of the feeding motor 40.

An optimum winding-back operation for the sheet R is continued until the sheet slack amount Spap=0(Tb), the load force on the sheet R between the LF roller 9 and the roll member Ro, i.e., Tpap>0, so that the sheet R attains a tense state. Thus, it is impossible to further perform the winding back operation on the sheet R, and the peripheral speed Vroll of the roll member Ro is "0." At this time, by reading an output signal from a feeding encoder 39, it is possible to determine that the sheet slack amount Spap=0 in step S04. When it is determined that the sheet slack amount Spap is "0," the feeding motor 40 is stopped, and the winding-back operation is completed in step S05.

By performing the operation in step S02 through step S05, it is possible to keep the slack amount Spap of the sheet R between the LF roller 9 and the roll member Ro always at the same level prior to the starting of the recording operation.

As illustrated in FIG. 9, the peripheral speed Vlf of the LF roller 9 exhibits an operational waveform having an acceleration area (Td–Te), a constant speed area (Te–Tf), and a deceleration area (Tf–Tg). When the LF roller 9 performs the sheet feeding operation in step S07, the roll member Ro is maintained in a state free from slack, so that it rotates at a speed substantially the same as the peripheral speed Vlf of the LF roller 9 in the acceleration area (Td–Te) and the deceleration area (Tf–Tg). Only, in the deceleration area (Tf–Tg), it takes time to stop the roll member Ro due to the influence of the inertia of the roll member Ro, and the LF roller 9 stops, generating slack in the sheet R between the LF roller 9 and the roll member Ro (the sheet slack amount Spap>0) in step S08.

When the feeding of the sheet R by the LF roller 9 and the roll member Ro is stopped, the recording operation is started in step S09. In this recording operation, ink is discharged from the recording head 11 toward the conveyed sheet R while moving the carriage 12 forwards or backwards at a predetermined speed to record an image corresponding to one line on the sheet R.

After the image corresponding to one line has been recorded, the feeding motor 40 is caused to continue rotation in the sheet winding back direction until the sheet slack amount Spap=0(Th), so that the sheet R is rewound in the sheet winding back direction.

At this time, in the winding back of the sheet R, in order that no deviation may be generated in the sheet R from the nip portion between the LF roller 9 and the pinch roller 10, the electric current for the feeding motor 40 is previously set according to the sheet information on the sheet R in step S10, thus determining the sheet winding back force. The electric current for the feeding motor 40 is set such that in the case of a slippery sheet R and a sheet R whose receptive layer is fragile, the sheet winding back force is weakened, and in the case of a sheet R which is slippery and of high stiffness, the sheet winding back force is enhanced (FIG. 7).

Further, regarding the completion of the winding-back operation of the sheet R, the output signal of the feeding encoder 39 is read to determine whether the sheet slack amount Spap=0 in step S12. When this sheet slack amount Spap becomes "0," the feeding motor 40 is stopped in step S13. The winding back operation of the sheet R is completed in a period between the stop of the sheet feeding operation of the LF roller 9 (Tg) and the start of the next sheet feeding operation of the LF roller 9 (Tc').

As described above, the load force Tpap at the time of winding back of the sheet is changed to an optimum load force for the sheet R according to the sheet information on the sheet R (the kind of sheet, sheet width, and winding diameter). As a result, a load force Tpap is attained which causes no deviation of the sheet R at the nip portion between the LF roller 9 and the pinch roller 10, and the conveyance operation of the LF roller 9 can maintain high accuracy.

After the sheet slack amount Spap has been reduced to 0 (Th), if the recording of the preceding one line has been completed, it is possible to start the sheet feeding operation for the next sheet R (Tc') (Th=Tc').

Through the above operation in step S07 through step S14, the recording operation for one line is repeated, until the recording of the entire page is completed in step S14, and the recording operation is completed in step S15.

As described above, in the above exemplary embodiment, after the sheet feeding operation of the LF roller 9 (Td−Tg), the sheet slack is removed which is generated by the continuation of the rotation of the roll member Ro due to the inertia of the roll member Ro (Spap>0). In this construction, when the sheet winding back operation is performed, in order to make the sheet slack amount Spap zero (Th) while the LF roller 9 is stopped (Tg−Tc'), the sheet winding back force is each time set to an optimum value according to the sheet information such as the kind of the sheet R, sheet width, and sheet winding diameter.

In the present exemplary embodiment, the take-up force when removing slack is controlled according to the winding diameter of the sheet R and the sheet width in addition to the kind of sheet R, so that it is possible to convey the sheet R in a stable manner. As a result, it is possible to prevent degeneration in recording image quality due to slippage of the sheet R on the LF roller 9 or deterioration in image quality such as crack due to excessive pulling of the sheet R.

In a conveyance apparatus according a second exemplary embodiment described below, the sheet R is slackened prior to start of the conveyance operation, and the slackened state is constantly maintained so that no tension may be applied to the sheet R even during the conveyance operation and an improvement is achieved in terms of conveyance accuracy.

The operational relationship between the LF roller 9 and the roller member Ro in the second exemplary embodiment will be described with reference to FIGS. 11, 12, and 10.

Figure 11:
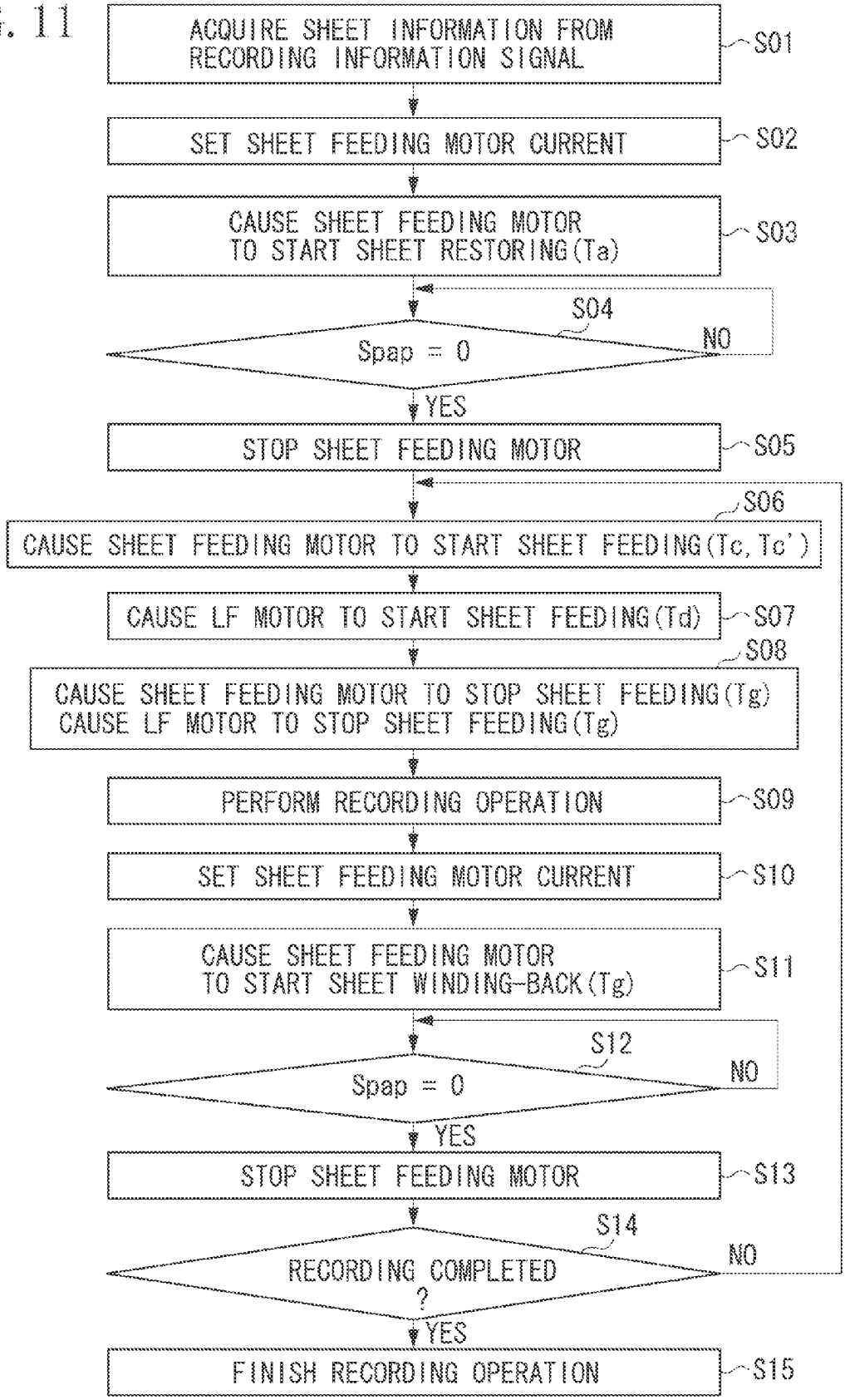
FIG. 11 is a flowchart illustrating the operation procedures in a second exemplary embodiment.
Figure 12:
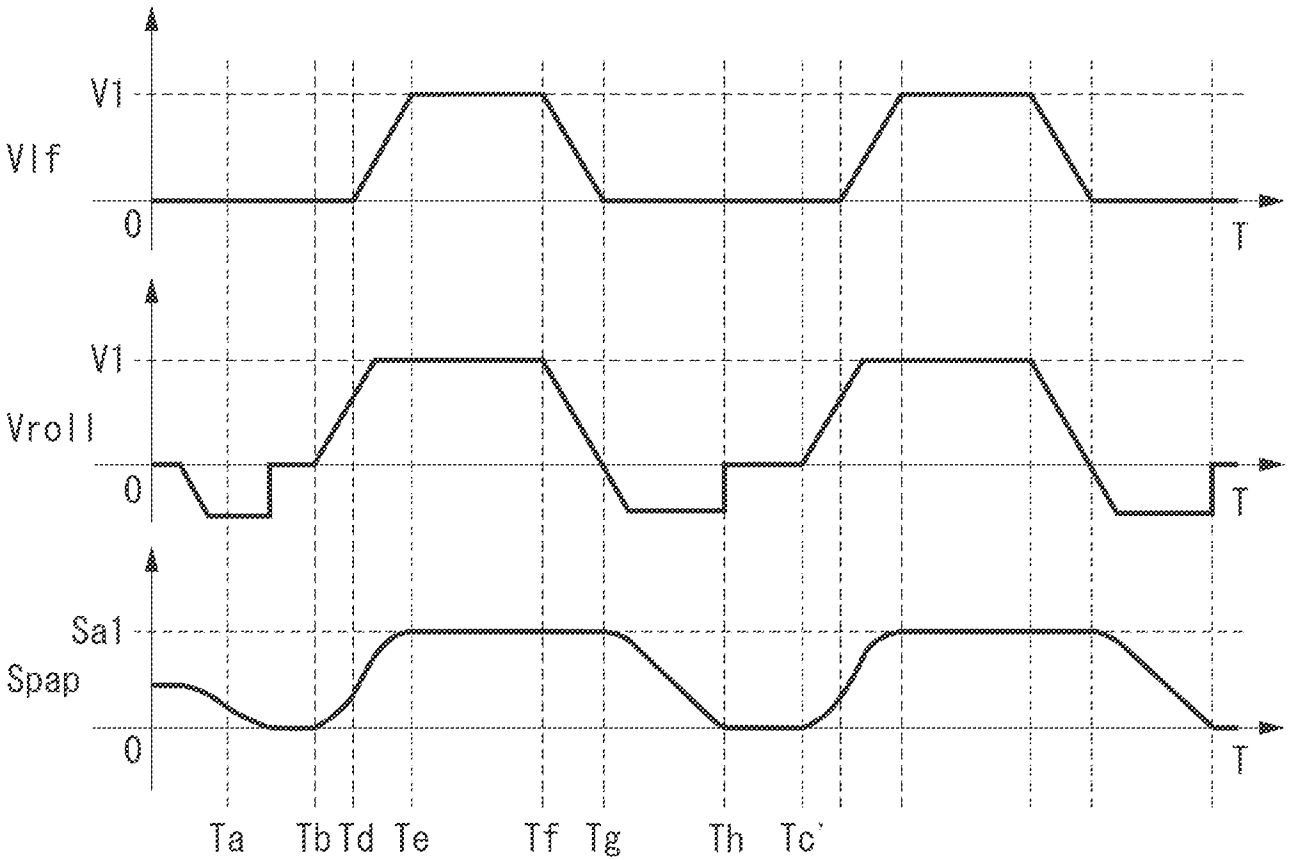
FIG. 12 is a diagram illustrating the relationship between the conveyance speed of the LF roller, the conveyance speed of the roll member, and the sheet slack amount in the second exemplary embodiment.

FIG. 11 is a flowchart illustrating the operational procedures according to the present exemplary embodiment. FIG. 12 is a diagram illustrating the peripheral speed of the LF roller 9, the peripheral speed of the roll member Ro of the sheet R, and the sheet slack amount in the present exemplary embodiment. In the graph in the top portion of FIG. 12, the vertical axis indicates the peripheral speed Vlf of the LF roller 9, and the horizontal axis indicates the time T. In the graph in the middle portion of FIG. 12, the vertical axis indicates the peripheral speed Vroll of the roll member Ro, and the horizontal axis indicates the time T. In the graph in the bottom portion of FIG. 12, the vertical axis indicates the sheet slack amount of the sheet R between the LF roller 9 and the roll member Ro, and the horizontal axis indicates the time T.

FIG. 10 illustrates the values of electric currents to be supplied to the feeding motor 40 for each kind of the sheet R. By supplying the electric current as given in FIG. 10, it is possible to execute proper winding-back without excess or deficiency. For example, when conveying the sheet M (fragile sheet), the electric current Am is supplied to the feeding motor 40. The feeding motor 40 is of such characteristics that the rotational torque increases in proportion to the supplied current. The control unit 101 varies this electric current value to control the take-up force.

As illustrated in FIG. 11, a signal of recording information output from the PC 100 is input to the control unit 101 of the printer 1 in step S01. Apart from the image information, the recording information output from the PC 100 includes sheet information (such as the kind of sheet), and, by receiving the signal of the recording information, it is possible to acquire the sheet information in step S01. As illustrated in FIG. 10, based on such sheet information, the value of the electric current to be supplied to the feeding motor 40 is set in step S02. At the time of winding-back of the sheet, the control unit 101 varies the value of the electric current to be supplied to the feeding motor 40 according to the sheet information, and an optimum winding back for the sheet R is started (Ta) in step S03.

For example, in the case of a slippery sheet R such as a glossy sheet, the electric current value (As) for the feeding motor 40 is diminished to reduce the load force Tpap on the sheet R between the LF roller 9 and the roll member Ro, so that slippage of the sheet R on the LF roller 9 is prevented. In the case of a sheet R with a fragile receptive layer, the electric current (Am) for the feeding motor 40 is further suppressed, and the load force Tpap on the sheet R between the LF roller 9 and the roll member Ro is diminished, so that it is possible to prevent slippage of the sheet R on the LF roller 9 or cracking of the sheet R.

On the other hand, in the case of a sheet R that is not subject to slippage and that is of high stiffness such as art paper, the electric current value (Ak) for the feeding motor 40 is increased to reliably wind back the sheet so that no deficiency of winding back may occur. Due to this operation, it is always possible to maintain the sheet slack amount Spap between the LF roller 9 and the roll member Ro in the same condition prior to the start of the recording operation. To summarize the above description, Am<As<Af<Ak.

The optimum winding-back of the sheet R is continued until the sheet slack amount Spap=0(Tb). Then, the load force Tpap on the sheet R between the LF roller 9 and the roll member Ro becomes larger than 0, with tension generated in the sheet R. Thus, it is impossible to perform further winding back of the sheet R, which makes the peripheral speed Vroll of the roll member Ro "0." At this time, by reading the output signal from the feeding encoder 39, it is possible to determine whether the sheet slack amount Spap=0 in step S04. When it is determined that the sheet slack amount Spap is "0," the feeding motor 40 is stopped, and the winding-back operation is completed in step S05.

Through this operation in step S02 through step S05, it is possible to maintain the sheet slack amount Spap of the sheet R between the LF roller 9 and the roll member Ro in the same condition all the time and prior to the start of the recording operation.

Here, the operation of the roll member Ro after the completion of winding back of the sheet prior to the start of recording operation will be described with reference to FIGS. 11 and 12. The peripheral speed Vlf of the LF roller 9 exhibits an operational waveform having an acceleration area (Td–Te), a constant speed area (Te–Tf), and a deceleration area (Tf–Tg). The roll member Ro is rotated in the sheet feeding direction prior to the start of the sheet feeding operation of the LF roller 9 (Tc) in step S06. As a result, slack is generated in the sheet R between the LF roller 9 and the roll member Ro, and the sheet slack amount Spap>0. After the sheet slack amount Spap>0(Td), the LF roller 9 is rotated in the sheet feeding direction in step S07. As a result, it is possible to reduce the load force T generated in the sheet R between the LF roller 9 and the roll member Ro to 0, making it possible to convey the sheet R in a stable manner.

The slack of the slack amount Spap is generated in a period between the start of the sheet feeding operation on the sheet R (Tc) and the termination of the deceleration area of the sheet R and the LF roller 9 (Tg) due to the difference between the peripheral speed Vroll of the roll member Ro and the peripheral speed Vlf of the peripheral speed of the LF roller 9. When the peripheral speed Vlf of the LF roller 9 has become higher than the peripheral speed Vroll of the roll member Ro, the sheet slack amount Spap generated in the area (Tc–Te) is gradually decreased. When the sheet slack amount Spap=0, tension is generated in the sheet R, with the result that the load force Tpap>0. Thus, it is necessary to make the peripheral speed Vlf of the LF roller 9 lower than the peripheral speed Vroll of the roll member Ro.

When the rotating speed of the feeding motor 40 is constant, the peripheral speed Vroll of the roll member Ro fluctuates according to the winding diameter of the roll member Ro. When the winding diameter of the roll member Ro is minimum, the peripheral speed Vroll of the roll member Ro is minimum, so that setting is made such that the peripheral speed Vroll of the roll member Ro at this time is equal to the peripheral speed Vlf of the LF roller 9 (Vroll=Vlf=V1). As a result, even if the winding speed of the roll member Ro is changed, it is possible to maintain the relationship: Vroll≥Vlf. Further, owing to the sheet slack amount Spap during the operation of the LF roller 9 when the winding diameter of the roll member Ro is minimum (Td–Tg), the condition: Spap>0, and the load force Tpap=0 can be maintained.

When the sheet feeding operation of the LF roller 9 is stopped (Tg), the sheet feeding operation of the roll member Ro is also stopped simultaneously with the stopping of the LF roller 9 in step S08.

When the sheet feeding operation of the LF roller 9 and the sheet R is stopped, the recording operation is started in step S09. In the recording operation, ink is discharged from the recording head 11 toward the conveyed sheet R while moving the carriage 12 forwards or backwards at a predetermined speed to record an image corresponding to one line.

Immediately after the stopping of the sheet feeding operation, the feeding motor 40 starts to operate in the sheet winding back direction until the sheet slack amount Spap=0(Th) in step S11. In this sheet winding back operation on the sheet R, a predetermined electric current is continually applied to the feeding motor 40 in step S10, so that the roll member Ro continually rotates in the sheet winding back direction to remove the slack from the sheet R.

At this time, in the sheet winding back operation for the sheet R, in order to generate no deviation in the sheet R from the nip portion between the LF roller 9 and the pinch roller 10, the value of the electric current for the feeding motor 40 is set according to the kind of the sheet R as illustrated in FIG. 10 to determine the sheet winding back force. In the case of a slippery sheet R or a sheet R with a fragile receptive layer, the electric current for the feeding motor 40 is set such that the sheet winding back force is enhanced. Further, to check the timing of completing the sheet winding back operation for the sheet R, the output signal from the feeding encoder 39 is read to determine whether the sheet slack amount Spap=0 in step S12. When this sheet slack amount Spap is reduced to "0," the feeding motor 40 is stopped in step S13.

The winding back operation of the sheet R is completed in a period between the stop of the sheet feeing operation of the LF roller 9 in step S13 and the start of the sheet feeding operation for the next sheet R (Tc'). As described above, it is only when the LF roller 9 is stopped that the load force Tpap>0 due to the sheet winding back operation on the sheet R. The load force Tpap is changed according to the kind of the sheet R. As a result, the load force Tpap is such that no deviation occurs in the roll sheet R at the nip portion between the LF roller 9 and the pinch roller 10, and the conveyance accuracy of the LF roller 9 is not affected.

After the sheet slack amount Spap=0(Th), if the recording of the preceding one line has been completed, it is possible to start the sheet feeding operation for the subsequent portion of the roll sheet R (Tc') (Th=Tc').

The above operation in step S06 through step S14 of recording one line is repeated until the recording of the entire page on the roll sheet R is eventually completed in step S14.

As described above, according to the present exemplary embodiment, control is performed such that the sheet slack amount Spap>0 during the sheet feeding operation of the LF roller 9 (Td–Tg), and the sheet R can be conveyed in a stable manner, in which the sheet feeding operation of the LF roller 9 is not affected by the kind of the sheet R. In this construction, when performing the winding back operation on the sheet R in order to make the sheet slack amount Spap=0(Th) while the LF roller 9 is stopped (Tg–Tc'), the sheet winding back force is each time set to an optimum value according to the kind of the sheet R. Thus, it is possible to prevent deterioration in recording image quality due to slippage of the sheet R on the LF roller 9 and degeneration in image quality due to crack or the like generated in the sheet R.

According to the above exemplary embodiment, it is possible to control the take-up force when removing slack from the recording material according to the kind of the sheet, making it possible to eliminate slack with an optimum take-up force for the characteristics of the sheet. Thus, it is possible to convey the sheet in a stable manner without slippage at the conveyance roller or cracking of the sheet surface generated due to excessive taking-up of the sheet, or defect in conveyance amount due to deficiency of taking-up.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-164171 filed Jul. 27, 2011, which is hereby incorporated by reference herein in its entirety.

What is claimed is:

1. A conveyance apparatus comprising:

a supply unit rotatably supporting a roll member around which a sheet is wound in form of a roll and configured to supply the sheet from the roll member;

a motor for rotating the roll member;

a roller pair configured to convey the sheet supplied from the supply unit while pinching the sheet; and a control unit configured to control the motor when taking up the sheet on the roll member by driving the motor while the sheet is pinched by the roller pair being stopped, such that the sheet is taken up with a torque corresponding to sheet information related to the sheet.

2. The conveyance apparatus according to claim 1, further comprising: a detection unit configured to detect the sheet information from the sheet or the roll member.

3. The conveyance apparatus according to claim 1, wherein the torque by the motor is controlled according to the kind of the sheet included in the sheet information.

4. The conveyance apparatus according to claim 3, wherein when taking up a sheet of a first width, the control unit effects control such that the torque by the motor is smaller than that when taking up a sheet of a second width larger than the first width.

5. The conveyance apparatus according to claim 3, wherein when taking up the sheet on a roll member of a first winding diameter, the control unit effects control such that the torque by the motor is smaller than when taking up the sheet on a roll member of a second winding diameter which is larger than the first winding diameter.

6. The conveyance apparatus according to claim 3, wherein when taking up a first sheet which is slippery on a roller, the control unit effects control such that the torque by the motor is smaller than when taking up a second sheet which is less slippery than the first sheet.

7. The conveyance apparatus according to claim 3, wherein when taking up a first sheet with a fragile ink absorbing receptive layer, the control unit effects control such that the torque by the motor is smaller than when taking up a second sheet with a fragile receptive layer is more resistant than the first sheet.

8. The conveyance apparatus according to claim 3, wherein when taking up a first sheet of low stiffness, the control unit effects control such that the force is smaller than when taking up a second sheet which is less stiff than the first sheet.

9. A printer having a printing unit configured to perform printing on a sheet conveyed by the roller pair of the conveyance apparatus according to claim 1.

10. The printer according to claim 9, wherein the sheet information is included in printing information about the printing performed by the printing unit.

11. The printer according to claim 10, further comprising an inputting unit configured to input image information to be printed and the printing information, from an external apparatus.

12. The conveyance apparatus according to claim 1, wherein the control unit is configured to control the motor for taking up the sheet, every time the roller pair conveys the sheet.

13. The conveyance apparatus according to claim 1, wherein the control unit is configured to perform the control by setting a torque, of the motor, corresponding to the sheet information.

14. The conveyance apparatus according to claim 13, wherein the control unit is configured to set the torque of the motor by setting a value, of electric current to be supplied to the motor, corresponding to the sheet information.

* * * * *